US006076280A

United States Patent [19]

Oechsle et al.

[11] Patent Number: 6,076,280

[45] **Date of Patent: *Jun. 20, 2000**

[54] METHOD AND DEVICE FOR DRYING A FIBER WEB

[75] Inventors: Markus Oechsle, Bartholomä; Kurt Dieter, Koenigsbronn-Zang; Peter Kahl, Gerstetten, all of Germany

[73] Assignee: Voith Sulzer Papiermaschinen GmbH, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/687,221

[22] Filed: Jul. 25, 1996

Related U.S. Application Data

[63] Continuation of application No. 08/687,221, Jul. 25, 1996.

[30] Foreign Application Priority Data

Jul. 26, 1995 [DE] Germany ..... 195 27 289

[51] Int. Cl.[7] ..... D21F 5/00; F26B 11/02

[52] U.S. Cl. ..... 34/456; 34/460

[58] Field of Search ..... 34/452, 453, 455, 34/456, 459, 460, 114, 115, 116, 117, 120, 126

[56] References Cited

U.S. PATENT DOCUMENTS

| | | | |
|---|---|---|---|
| 4,510,698 | 4/1985 | Ely | 34/117 |
| 4,835,881 | 6/1989 | Welsby | 34/117 |
| 5,044,095 | 9/1991 | Eivola | 34/117 |
| 5,379,526 | 1/1995 | Haverinen | 34/114 |
| 5,477,624 | 12/1995 | Haessner et al. | 34/117 |
| 5,515,619 | 5/1996 | Kahl et al. | 34/114 |
| 5,537,755 | 7/1996 | Kotitschke | 34/117 |
| 5,560,123 | 10/1996 | Esklinen | 34/414 |

FOREIGN PATENT DOCUMENTS

| | | |
|---|---|---|
| 1336535 | 8/1995 | Canada . |
| 3818600 | 12/1988 | Germany . |

*Primary Examiner*—Heney Bennett
*Assistant Examiner*—Steve Gravini
*Attorney, Agent, or Firm*—Ostrolenk, Faber, Gerb & Soffen, LLP

[57] ABSTRACT

A web drying apparatus, e.g., for a paper web, includes several heatable drying cylinders arranged in at least one row with at least one respective endless loop drying wire and preferably arranged in two rows of cylinders with two respective wires. A wire guide roll is between and offset from two of the adjacent cylinders in the one row. The one endless loop dryer wire carries the web thereon on a first part of the web loop path from the first cylinder to the wire guide roll. There the web separates from the wire and travels to a second cylinder in the second row. The wire wraps around the wire guide roll and returns on a second part of the web loop path to the next cylinder in the first row, without supporting a web. On the path between the first and third cylinders and around the wire guide roll, the wire defines a loop. An air guide box and a blower are arranged within the loop. The air guide box produces a vacuum at the first part of the wire loop path for drawing the web against the wire. An air channel extends between the air guide box and the blower. At least one drive nozzle outlets into the air channel. The air channel draws air out of the first part of the loop path to create the vacuum there. The blower directs a stream of air through the wire, at the second part of the wire loop path, and then to a pocket outside the second loop part. The drive nozzle and the blower are supplied by independently controlled flows of blown air.

8 Claims, 2 Drawing Sheets

METHOD AND DEVICE FOR DRYING A FIBER WEB

CROSS-REFERENCE TO RELATED APPLICATION

This is a Continuation of application Ser. No. 08/687,221, filed Jul. 25, 1996, now abandoned.

BACKGROUND OF THE INVENTION

The present invention relates to a method for drying a fiber web using a two wire and two row drying cylinder arrangement. The invention has particular use in a papermaking machine. The invention concerns supplying air flows at, through or near different parts of the loop path of the dryer wire in the path between adjacent drying cylinders in one row for effective web control. The invention concerns a method and an apparatus for the carrying out such a method related to the air flows.

The prior art includes U.S. Pat. No. 5,379,526 (FIG. 2) and Federal Republic of Germany 44 04 726 (FIG. 6).

Constructions in the above cited prior art have the following features in common:

1. Upon the web to be dried leaving a "first" drying cylinder, the web first travels a distance together with and is therefore supported by a first wire generally up to a wire guide roll that is off the row of the first drying cylinder wire and is toward the other row of drying cylinders. After leaving this guide roll, the web separates from the wire and travels unsupported to the following "second" drying cylinder which is part of the other row of cylinders. Thus, the "free web paths" or open draws, i.e., the web travel paths over which the web is not supported, are relatively short. This prevents the danger of fluttering of the web and tearing of the web. In regions where the paper web and/or the drying wire do not rest on a closed surface, for instance, a cylinder surface or a guide roll surface, they can dry more or less undisturbed.

2. The drying wire coming from the first drying cylinder in the first row wraps around the wire guide roll. There the web separates from the wire. Then the wire travels from the guide roll back to the next "third" drying cylinder in the first row of cylinders, thereby forming a loop of the wire or a pocket. This loop contains a so called air guide box.

3. A sealing element supported by the air guide box prevents a layer of boundary air from being drawn into the loop. That layer of boundary air is carried along by the wire traveling over the first cylinder.

4. A second region of the wire loop extends from the guide roll to the third drying cylinder. In the second region, the drying wire is not covered by the web. A second flow of air is required in the second region to ventilate the so called "pocket", i.e., the region between the drying wire and the web of paper that is spaced away from the wire and that is traveling onto the next, i.e., third cylinder. The second flow of air blows through the drying wire. This so called pocket ventilation is effected in FIG. 6 of Federal Republic of Germany '726 by means of a blower which is arranged in the "run-off gusset" between the wire guide roll and the departing wire.

In many cases, it has been found that the known method of producing a vacuum along the first part of the wire loop, between the first cylinder and the guide roll and/or the known method of ventilating the pocket are not sufficient.

The operating speeds of modern papermaking machines have greatly increased in recent years. Some are now operating at a speed of 1800 m/min. and more. This makes it necessary to increase the drying performance of each drying cylinder and thus to increase the amount of drying air necessary for removing the vapors that come off the web as it is dried. To do this, more air must be forced into the pocket through the uncovered drying wire. At the same time, despite the greater web travel speed, the web travel must be as stable and quiet as possible.

SUMMARY OF THE INVENTION

The object of the present invention is to satisfy these requirements as much as possible.

A web drying apparatus, e.g., for a paper web, includes several heatable drying cylinders arranged in at least one row over which passes at least one endless loop drying wire, and the drying cylinders may be arranged in two rows of cylinders, each row with a respective drying wire. A wire guide roll is located between and offset from two of the adjacent cylinders in the one row. The one endless loop dryer wire carries the web thereon on a first part of the loop path from the first cylinder to the wire guide roll. There the web separates from the wire, and the web travels to a second cylinder in the second row. The wire does not travel to the second row but instead wraps around the wire guide roll and returns on a second part of the loop path to the next, third cylinder in the first row, without supporting a web along the second part. On the path between the first and third cylinders and around the wire guide roll, the wire defines a loop.

An air guide box and a blower are arranged within the wire loop. The air guide box produces a vacuum at the first part of the wire loop path for drawing the web against the wire. An air channel extends between the air guide box and the blower. At least one drive nozzle outlets into the air channel. The air channel draws air out of the first part of the loop path to create the vacuum there. The blower directs a stream of air through the wire at the second part of the wire loop path, and the air blows into a pocket outside the second part of the wire loop path. The drive nozzle and the blower are supplied by independently controlled flows of blown air.

A stream of air under pressure is fed solely to the blower in order to intensify the ventilation of the pocket in accordance with prevailing requirements. Independently, a second stream of air makes the vacuum present in the first part of the loop path adjustable by means of a drive nozzle, again in accordance with the prevailing requirements. For this purpose, an air channel extends from the first part of the wire loop between the air guide box and the blower. This air channel is known from the aforementioned publications. In the known arrangements, however, the same air channel not only draws air out of the first part of the loop path but also ventilates the pocket. However, this may not ventilate the pocket to a sufficient extent. In contrast, the method and the apparatus of the invention provide the advantage that the blower can be acted upon by an air throughput which is as high as desired in order to intensify the ventilation of the pocket as much as desired. The division of the system into two individual systems is also advantageous because their individual functions can now be controlled individually.

BRIEF DESCRIPTION OF THE DRAWING

Other objects and features of the invention will be apparent from the following description and the accompanying drawing in which.

DESCRIPTION OF A PREFERRED EMBODIMENT

Figure 1:
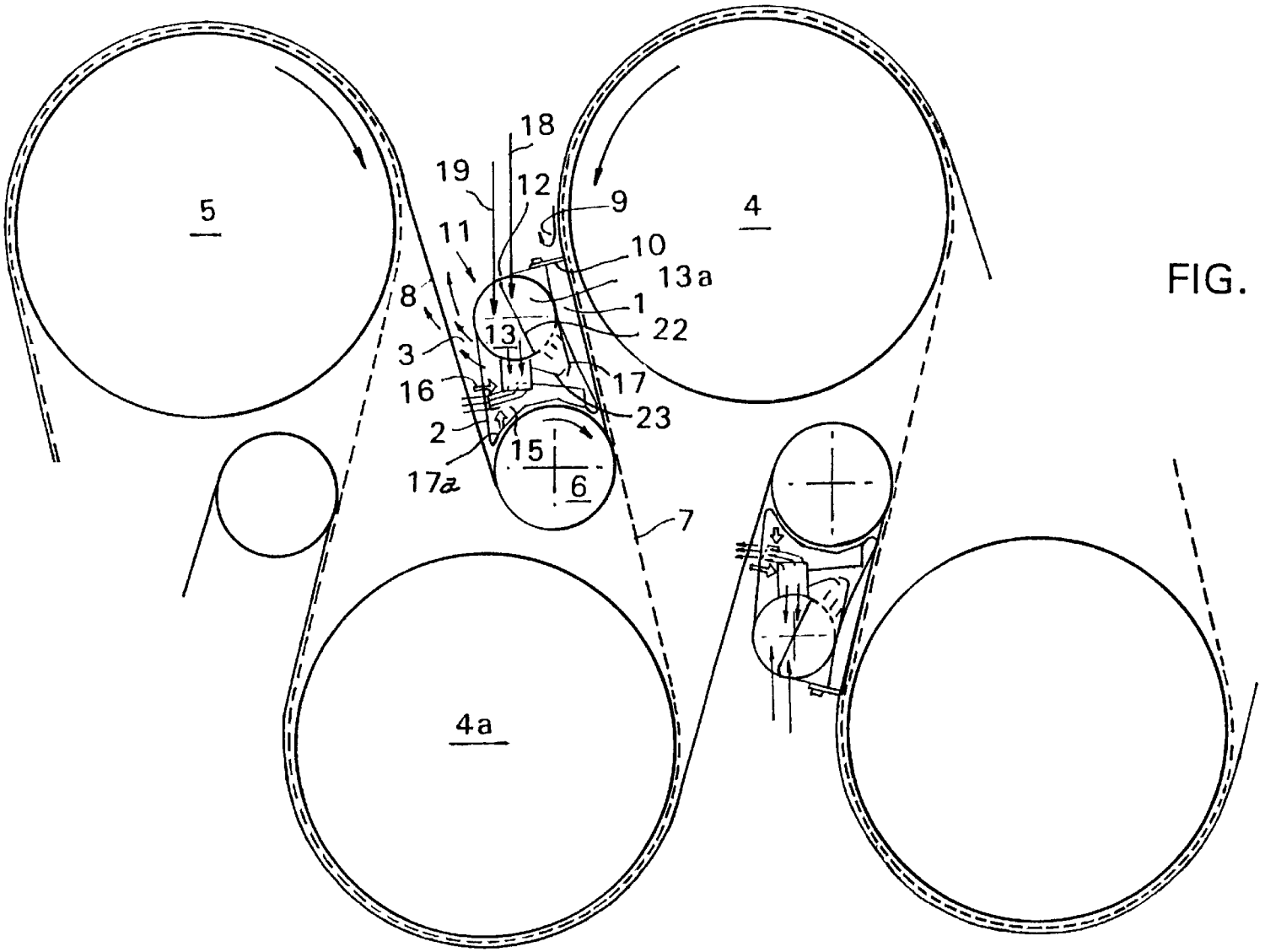
FIG. 1 is a diagrammatic longitudinal section through a two wire drying cylinder arrangement, showing one wire and two associated cylinders and a roll.
Figure 2:
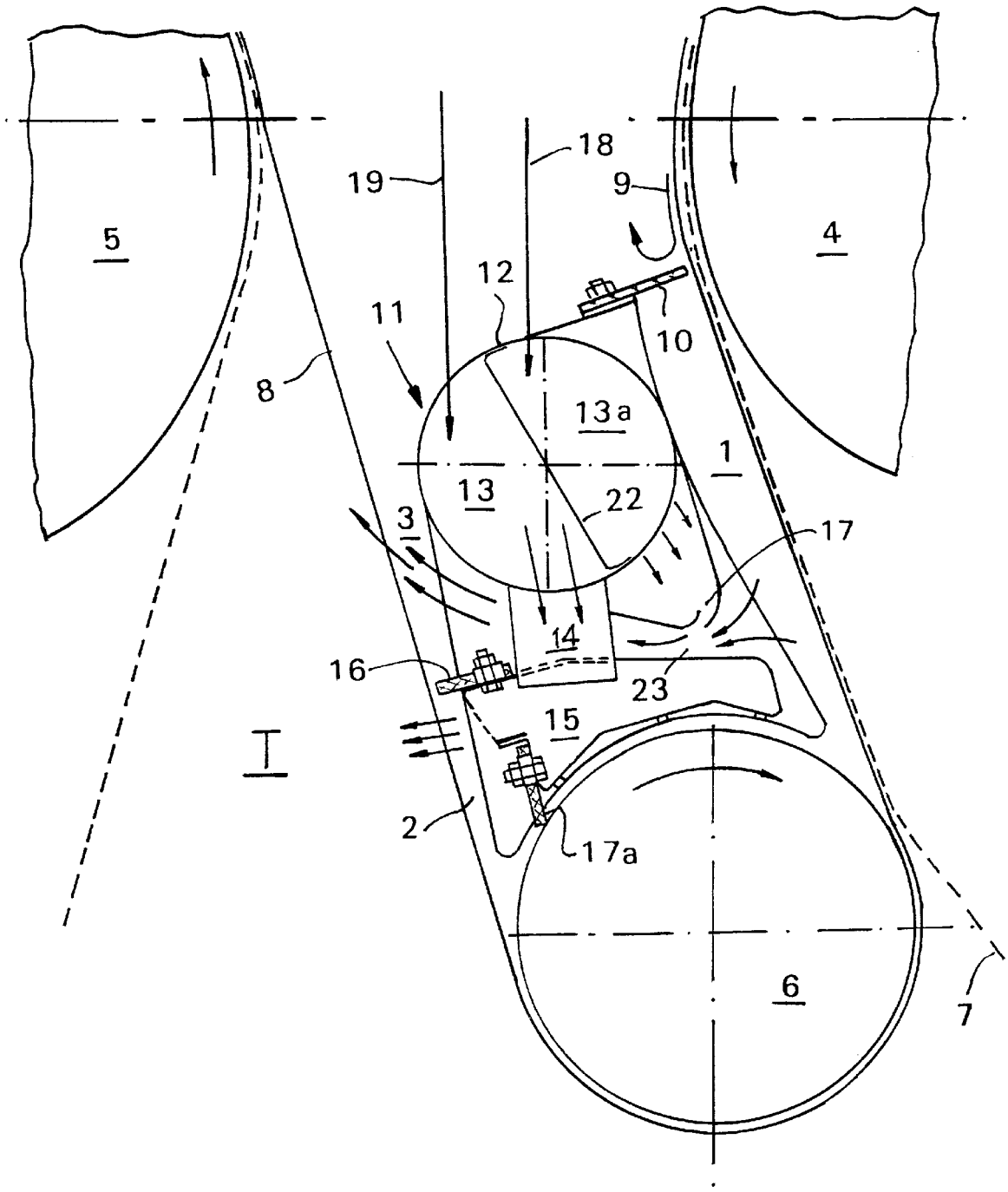
FIG. 2 is an enlargement of a portion of FIG. 1.

The paper web 7 to be dried and the drying wire 8 travel together off a first cylinder 4 in a first row of cylinders. On the side of the drying wire facing away from the drying cylinder 4, a layer of boundary air 9 is entrained. It is deflected by a seal 10 at the top of the air guide box 11 which is in the pocket defined by the adjacent top row cylinders 4, 5 and by the wire guide roll 6 which is off the first row of cylinders and toward the second row thereof. The drying wire and the paper web now travel together in the direction from the first cylinder 4 toward the drying wire guide roll 6.

The paper web 7 travels unsupported from the drying wire guide roll 6 to the next in the web path, second drying cylinder of the second row of cylinders, which is not shown, but is known from the conventional two row design. See the above references incorporated by reference.

The air guide box 11 feeds the drive nozzle 17 with air via line 18 and channel 13*a*. The flow of air subsequently into the channel 23 creates and exerts vacuum on the wire loop first region 1. In this way, in the region 1, the paper web 7 is supported on the path between cylinder 4 and drying wire guide roll 6 by the drying wire 8. Furthermore, vapors which escape from the drying wire 8 in this region are transported away. These masses of air pass through the channel 23 into the region 3, where they can flow off undisturbed. A part thereof may possibly also enter the pocket T through the second part of the wire loop path.

A further part of the apparatus, namely the blower 15, has a separate air path from the part described above. The blower 15 is arranged at the "bottom" of the loop and therefore in the direct vicinity of the wire guide roll 6. It has a plurality of blow openings which are directed through the wire 8 into the pocket T. The blower 15 is provided with compressed air via a line 19 and channels 13 and 14. However, it is also possible for the blower 15 to have a lateral compressed air connection of its own. In that case, no connecting channels 14 are required between the support tube 11 and the blower 15.

As another alternative, there may be a common source of compressed air connected to the lines 18 and 19 and their respective channels, and for control then, there would be an adjustable choke for the channel from the drive nozzle.

The gusset shaped region 2 of the loop (defined between blower 15, wire guide roll 6 and wire 8) is limited by sealing elements 16 and 17*a*. The one seal 16 extends along the path of travel of the wire 8 and the other seal 17*a* extends along the wall of the wire guide roll 6.

The Figure shows a few other preferred, but not absolutely necessary, features. The air guide box 11 has a pipe 12 as a supporting element. The inside of the pipe is divided by a partition 22 into two halves which form the channels 13 and 13*a*. The channel 14 rigidly connects the blower 15 with the pipe 12.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A method for drying a fiber web in a drying section of a web drying machine, the method comprising:

moving a first endless dryer section wire into contact with and on the outward facing side of the web as the web and the wire move together in contact with a first drying cylinder;

moving the wire in continuous contact with the web from the first cylinder to a wire guide roll defining a first part of a loop path of the wire between the first cylinder and the wire guide roll;

separating the web from the wire at the wire guide roll;

moving the wire without the web around the wire guide roll and then from the wire guide roll to the next cylinder in the same row as the first cylinder for defining a second part of the loop path of the wire between the wire guide roll and the next cylinder, such that the wire moving around the wire guide roll defines a loop between the first and the next cylinders;

producing a vacuum in the first part of the loop path between the first cylinder and the wire guide roll for holding the web which is on the outside of the wire fast on the wire moving past the first part of the loop path, wherein the vacuum is produced at the first part of the loop path by deflecting a first air boundary layer, that is entrained by the outward facing side of the wire, away from the wire as the wire passes over the first cylinder, the deflection of the first air boundary layer being before the contacting wire and web separate from the first cylinder, and also by deflecting a second air boundary layer that is entrained by the wire guide roll away from the wire guide roll, the deflection of the second air boundary layer being after the wire separates from the wire guide roll and before the wire guide roll reaches the first part of the loop path, and also by producing a first controllable air stream directed away from the first part of the loop path and not directed at either of the first and second deflected air boundary layers; and producing pressure at the second part of the loop path by producing a second air stream for blowing air through the wire in the second part of the loop path which blows air through the wire and out of the loop.

2. The method of claim 1, wherein the vacuum at the first part of the loop path is also produced by drawing air out of the first part of the loop path by means of a drive nozzle.

3. The method of claim 1, wherein the web is directed from the wire guide roll to a third cylinder in another row of cylinders, and the web returns to the next cylinder on a path that passes and is spaced away from the second part of the loop path and outside the loop, defining a pocket between the second part of the loop path and the web moving toward the next cylinder in the first row.

4. The method of claim 1, wherein the first air boundary layer is deflected with a first sealing ledge and the second air boundary layer is deflected with a second sealing ledge.

5. The method of claim 4, wherein the vacuum at the first part of the loop path is also produced by directing the first stream between the first and second sealing ledges.

6. The method of claim 5, wherein the vacuum at the first part of the loop path is also produced by directing the first stream between first and second fixed structures, the first fixed structure being proximate the first cylinder and the second fixed structure being proximate the wire guide roll, the first sealing ledge being sealingly attached to the first fixed structure and the second sealing ledge being sealingly attached to the second fixed structure.

7. The method of claim 1, wherein the first and second air streams are separately controllable and the method further comprising separately controlling the first and second air streams.

8. The method of claim 2, wherein the first and second air streams are separately controllable and the method further comprising separately controlling the first and second air streams.

* * * * *